United States Patent [19]

Hill

[11] 4,197,061

[45] Apr. 8, 1980

[54] ROTARY PNEUMATIC VANE MOTOR WITH ROTATABLE TUBING CONTACTED BY VANES

[75] Inventor: Horace E. Hill, Renton, Wash.

[73] Assignee: Boeing Commercial Airplane Company, Seattle, Wash.

[21] Appl. No.: 864,565

[22] Filed: Dec. 27, 1977

[51] Int. Cl.[2] ..... F01C 1/02; F01C 13/02; F01C 21/02; F16C 32/06

[52] U.S. Cl. ..... 418/173; 418/270; 308/9; 308/DIG. 1

[58] Field of Search ..... 418/173, 270; 308/9, 308/DIG. 1

[56] References Cited

U.S. PATENT DOCUMENTS

| | | | |
|---|---|---|---|
| 4,120,623 | 10/1978 | Lohn | 418/270 |

FOREIGN PATENT DOCUMENTS

| | | | |
|---|---|---|---|
| 1425057 | 5/1969 | Fed. Rep. of Germany | 308/9 |
| 2621485 | 12/1977 | Fed. Rep. of Germany | 418/173 |
| 1286068 | 1/1962 | France | 418/173 |
| 263228 | 12/1926 | United Kingdom | 418/173 |
| 1020883 | 2/1966 | United Kingdom | 308/9 |

*Primary Examiner*—John J. Vrablik

*Attorney, Agent, or Firm*—Morris A. Case; Bernard A. Donahue

[57] ABSTRACT

A cylindrical shaped tube freely rotatable within a housing provides the pressure chamber for an eccentrically mounted rotary seal vane type pneumatic motor with the drive actuating air moving axially through the pressure chamber.

2 Claims, 5 Drawing Figures

ROTARY PNEUMATIC VANE MOTOR WITH ROTATABLE TUBING CONTACTED BY VANES

BACKGROUND OF THE INVENTION

Rotary seal vane-type pneumatic motors are used extensively in industry as these units have a high power-to-weight ratio. The seal in these motors is accomplished by rotating vanes pressing against the inside surface of a housing, which causes wear and loss of energy due to the rubbing action. Heat generated by this rubbing action is dissipated by directing oil laden air radically through the sides of the housing.

U.S. Pat. No. 2,918,877 to Woodcock discloses a vane-type pump with a rotatable ring as the pressure chamber and fluid under pressure is directed to that part of the outer periphery of the ring on the pressure side of the pump.

U.S. Pat. No. 2,685,256 to Humphreys shows a rotary pump or motor with successive pressure blocks moving inside a freely rotatable ring supported by an antifriction bearing.

SUMMARY OF THE INVENTION

A freely rotatable cylindrical shaped tubing located within the housing of a pneumatic motor forms the radial boundary of a drive chamber for the rotating vanes of a rotary seal vane type motor. The driving air flows axially through the chamber with the chamber rotating at essentially the same revolutions per minute as the driven rotating vanes. The rotating tubing is supported by a bearing.

DETAILED DESCRIPTION

Figure 1:
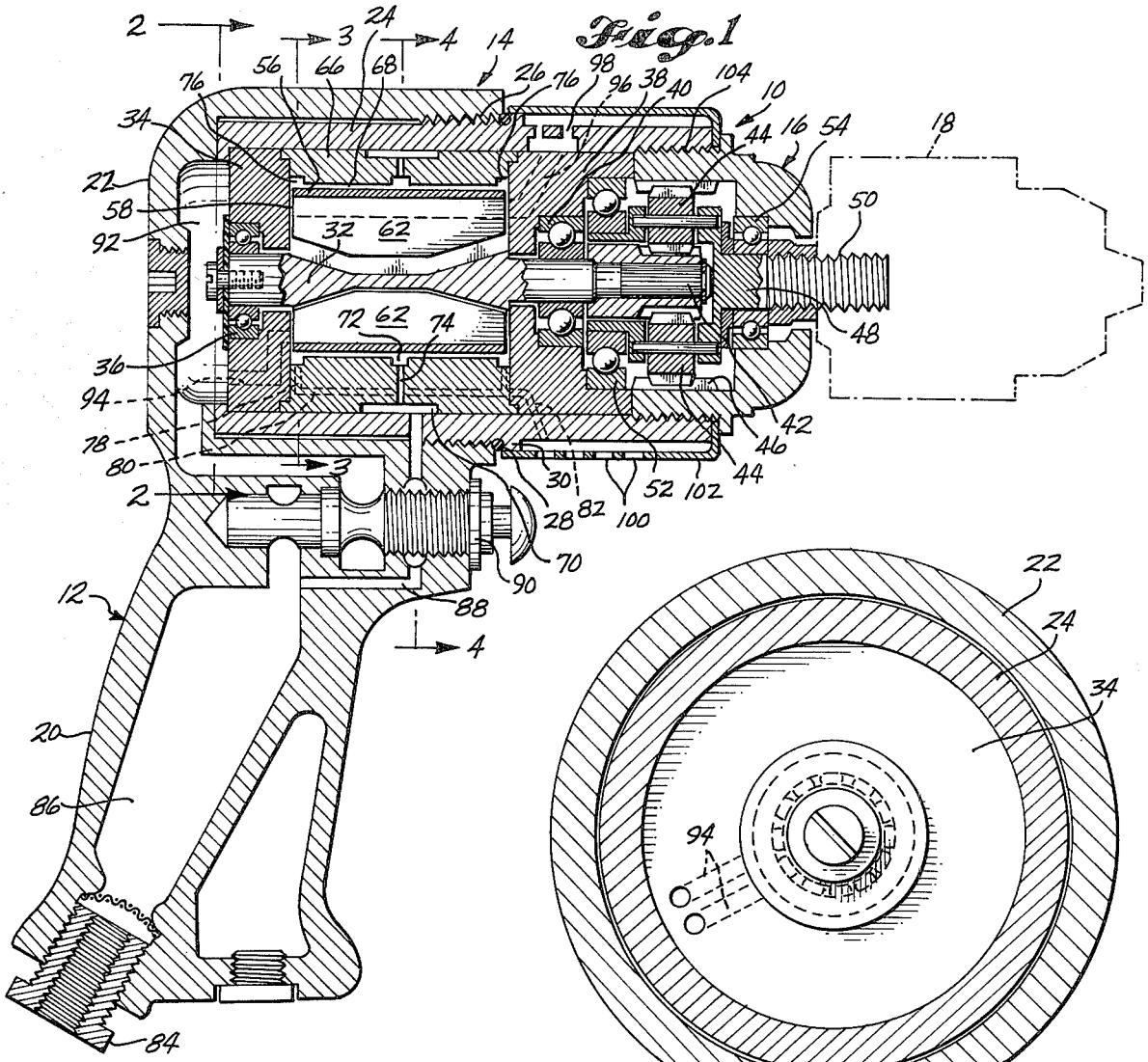
FIG. 1 shows a side elevational sectional view of the pneumatic motor of this invention.
Figure 2:
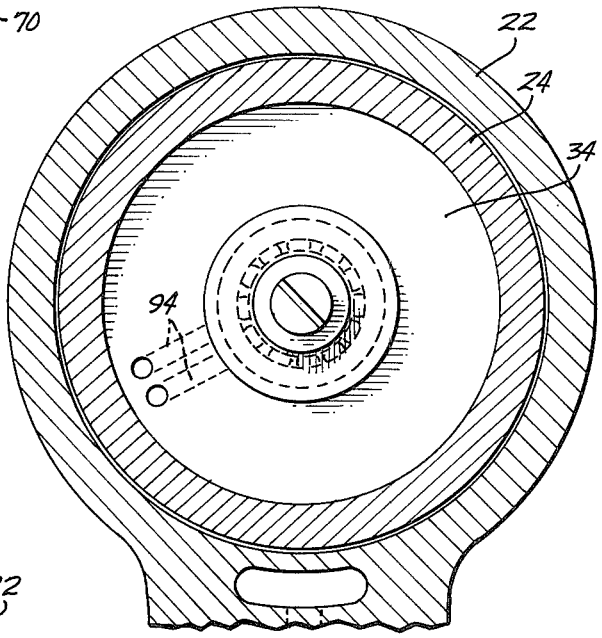
FIG. 2 is a fragmented sectional view of this invention taken along line 2—2 of FIG. 1.
Figure 3:
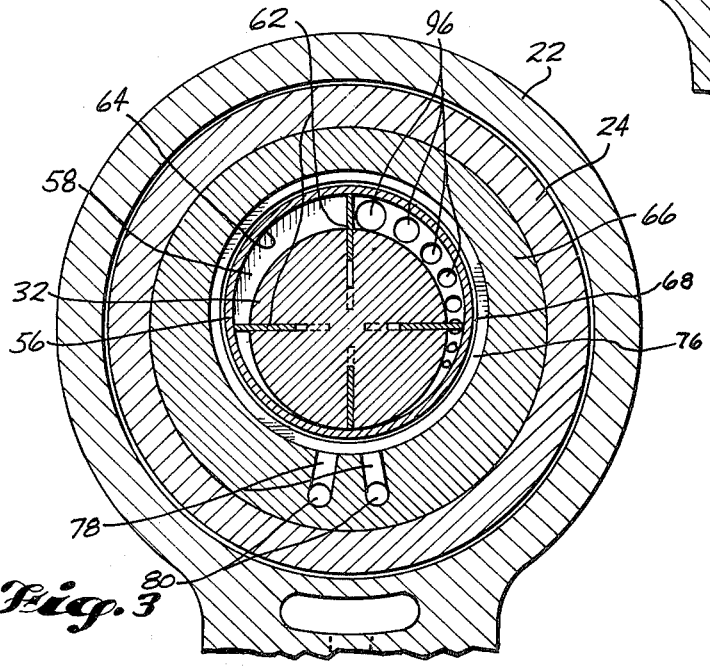
FIG. 3 is a fragmented sectional view taken along line 3—3 of FIG. 1.
Figure 4:
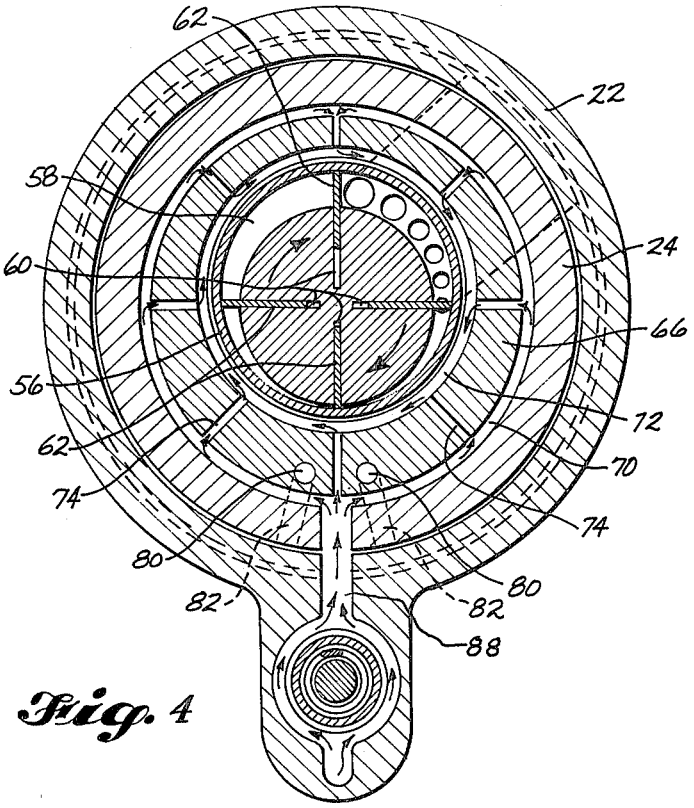
FIG. 4 is a sectional view taken along line 4—4 of FIG. 1.

Pneumatic motor 10 has handle 12, drive mechanism 14, driven gear reduction mechanism 16 and driven adapter 18 for converting the unit to useful work. In this embodiment the adapter, shown in phantom, is of a drill chuck; however, various adapters for performing other types of work may be used and it is not desired to limit the adapter to a drill chuck. A hand grip housing 20 of the handle in this embodiment is integrally joined to a barrel 22 of the drive mechanism. Housing 24 inserts into the barrel and is threadibly joined at 26. The housing is sealed air-tight within the barrel with O-ring seal 28, which is kept in place by abutting against flange 30 as the housing is tightened. A rotor 32 is axially centrally located within the housing, is mounted at one end to a rear plate 34 with a roller bearing 36, and is mounted near the other end to a front plate 38 with a roller bearing 40. A pinion gear 42 joined to the end of the rotor 32 works in conjunction with planetary gears 44 and planet cage 46 to provide gear reduction to driven shaft 48, which is threaded at 50 to provide means for joining to the adapter 18 for a working tool. The gear mechanism and drive shaft are supported by bearings 52 and 54. A cylindrical shaped member or elongated ring 56 is located between the rear plate 34 and the front plate 38 is situated to have an eccentric axis with respect to the rotor 32, is freely rotatable and forms a drive chamber 58 in conjunction with the end plates. The rotor has four radially extending slots 60 in which vanes 62 are slideably mounted. As the rotor spins, the vanes move outward to remain in contact with the inside surface 64 of the ring. Encircling the cylindrical shaped ring 56 is a support member 66. This member has a close fit spacing 68 around the periphery of the ring, has a recess 70 around the outer periphery and a recess 72 around the inner periphery that are centrally located with respect to longitudinal direction, and a series of radial slots 74 interconnecting the recesses. The support member also has recesses 76 around the inside periphery at each end, and connecting downwardly extending slots 78 which communicate with longitudinally extending slots 80. These latter slots in turn communicate with slots 82 which extend through from plate 38 and housing 24.

To operate this pneumatic motor compressed air from a source not shown goes through hose adapter 84, into chamber 86 in the handle through lines 88 into recesses 70 and 72. The air then flows both ways along the close tolerance space 68 to provide an air bearing between the cylindrical ring 56 and its support member 66 to allow the ring to rotate freely. Next, the trigger valve 90 is actuated, which directs the compressed air into space 92, through channels 94, and into drive chamber 58 to revolve the rotor 32 and sealing vanes 62, thence pass through exhaust channels 96 which are located in the end plate 38. As the vanes rotate, friction between the vanes and the inside surface of the cylindrical shaped ring causes the ring to rotate within the support member at essentially the same speed as the vanes. The exhaust air as it leaves channels 96 is directed through openings 98 in the housing 24 and is then directed through openings 100 in an encircling ring 102. This ring may be loosened and rotated to direct the air as desired by loosening the planet cage 46 on threads 104. In this invention the compressed air moves axially through the driving chamber formed by the cylindrical shaped ring.

Figure 5:
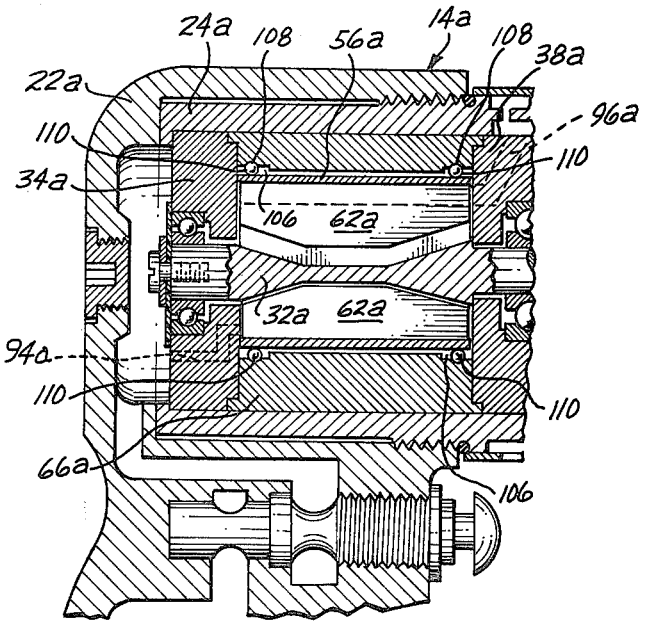
FIG. 5 is a fragmented side elevational sectional view of another embodiment of this invention.

In yet another embodiment as shown in FIG. 5 the drive mechanism **14*a* has barrel 22*a*, housing 24*a*, rear end plate 34*a*, front end plate 38*a*, rotor 32*a*, vanes 62*a*, cylindrical shaped tubing 56*a*, support member 66*a*, air inlet channels 94*a*, and air exhaust channels 96*a*, all of which serve functions similar to the functions of drive mechanism 14. In this embodiment, however, the cylindrical shaped ring is supported by an antifriction bearing instead of an air bearing. The support member 66*a* does not have air slots, but does have annular recesses 106 near each end of the inside diameter with the recesses having an annular groove 108 with just enough depth in the groove to align a series of ball bearings 110 and act as the outer race for the bearing. The cylindrical shaped ring 56*a*** acts as the inner race. Alternately, the cylindrical ring will have annular grooves aligned to accept the ball bearings.

I claim:

1. An improved rotating seal vane type pneumatic motor wherein the improvement comprises: a solid elongatged annular ring forming a drive chamber for a rotor with sealing vanes of a pneumatic motor, axially located compressed air inlet and exhaust air outlet to the driving chamber, a concentric support member encircling the ring and having a close tolerance between the two members, an annular recess around the inner periphery of the support member at each end and in the middle, means for introducing compressed air through the support member into the middle annular recess, and means for exhausting air from the two end annular recesses to provide an air bearing and permit free rotation of the elongated ring in response to contact by sealing vanes as the rotor with vanes are rotated by driving air in the drive chamber.

2. An improved rotating seal vane type pneumatic motor as in claim 1 further comprising: gear reduction means joined to the motor for driving a working tool.

* * * * *